United States Patent [19]

Jacobsen

[11] Patent Number: 4,475,928

[45] Date of Patent: Oct. 9, 1984

[54] METHOD FOR THE RECOVERY OF PETROL (GASOLINE) FROM A MIXTURE OF PETROL VAPOR AND AIR, AND A SYSTEM FOR USE IN THE METHOD

[76] Inventor: Anker J. Jacobsen, Bjergbakkevej 45, DK-2600 Glostrup, Denmark

[21] Appl. No.: 463,878

[22] PCT Filed: May 25, 1982

[86] PCT No.: PCT/DK82/00048

§ 371 Date: Jan. 24, 1983

§ 102(e) Date: Jan. 24, 1983

[87] PCT Pub. No.: WO82/04260

PCT Pub. Date: Dec. 9, 1982

[30] Foreign Application Priority Data

May 25, 1981 [DK] Denmark ..... 2275/81

[51] Int. Cl.[3] ..... B01D 53/14

[52] U.S. Cl. ..... 55/20; 55/48; 55/50; 55/88; 55/89; 55/217; 55/228

[58] Field of Search ..... 55/20, 48–51, 55/88, 89, 160, 195, 208, 217, 218, 228

[56] References Cited

U.S. PATENT DOCUMENTS

| | | | |
|---|---|---|---|
| 1,771,409 | 7/1930 | Isom | 55/88 X |
| 1,934,029 | 11/1933 | Asbury | 55/48 |
| 2,497,421 | 2/1950 | Shiras | 55/89 X |
| 2,765,872 | 10/1956 | Hartman et al. | 55/88 |
| 2,943,703 | 7/1960 | Thayer | 55/51 X |
| 2,974,750 | 3/1961 | Retallick | 55/51 |
| 3,324,627 | 6/1967 | Kohrt | 55/51 X |
| 3,345,802 | 10/1967 | Wyatt | 55/50 |
| 3,855,337 | 12/1974 | Foral, Jr. et al. | 55/88 X |
| 3,861,890 | 1/1975 | Doncer et al. | 55/88 |
| 3,867,112 | 2/1975 | Honerkamp et al. | 55/89 X |
| 3,869,264 | 3/1975 | Richards | 55/88 |
| 3,907,524 | 9/1975 | Haines, Jr. | 55/88 |
| 3,947,258 | 3/1976 | Decker | 55/88 |
| 4,043,769 | 8/1977 | Nishino et al. | 55/89 X |
| 4,101,297 | 7/1978 | Uda et al. | 55/88 X |
| 4,106,916 | 8/1978 | Tuckett et al. | 55/49 X |
| 4,302,220 | 11/1981 | Volkamer et al. | 55/48 X |

FOREIGN PATENT DOCUMENTS

| | | | |
|---|---|---|---|
| 470069 | 12/1950 | Canada | 55/51 |
| 2218199 | 10/1973 | Fed. Rep. of Germany . | |
| 2325421 | 12/1974 | Fed. Rep. of Germany . | |
| 391946 | 3/1977 | Sweden . | |

*Primary Examiner*—Robert Spitzer

*Attorney, Agent, or Firm*—Finnegan, Henderson, Farabow, Garrett & Dunner

[57] ABSTRACT

In a method of the type where petrol is recovered from a mixture of petrol vapor and air by absorption of the petrol in a cooled petroleum distillate, a petroleum distillate having a boiling point range higher than that of the petrol is used, and this petroleum distillate is in sequence cooled by heat exchange with a cold reservoir, brought into direct contact with the petrol/air mixture to absorb petrol, transferred to a buffer tank and transferred from the buffer tank to a stripping means which may be a distillation column. By combining cooling condensation and absorption of the petrol vapor and controlling the amount of cooled petroleum distillate brought into contact with the petrol/air mixture so that the petrol concentration in the petroleum distillate transferred to the buffer tank is substantially constant, an unprecedented optimum control of the petrol absorbing process can be obtained both in peak load and in average load operations. A system for carrying out the method is advantageous in that only the absorption means (2) need be dimensioned for peak load operation, while the other components, such as the distillation column (5) or a heat exchanger (4) with associated conduits can be dimensioned for average loads, a buffer tank (3) being provided to temporarily receive the petroleum distillate which owing to the above-mentioned control (15, 16) has a substantially constant, maximum petrol concentration so that the system can cope with peak loads with a surprisingly small buffer tank (3).

14 Claims, 2 Drawing Figures

Figure 1:
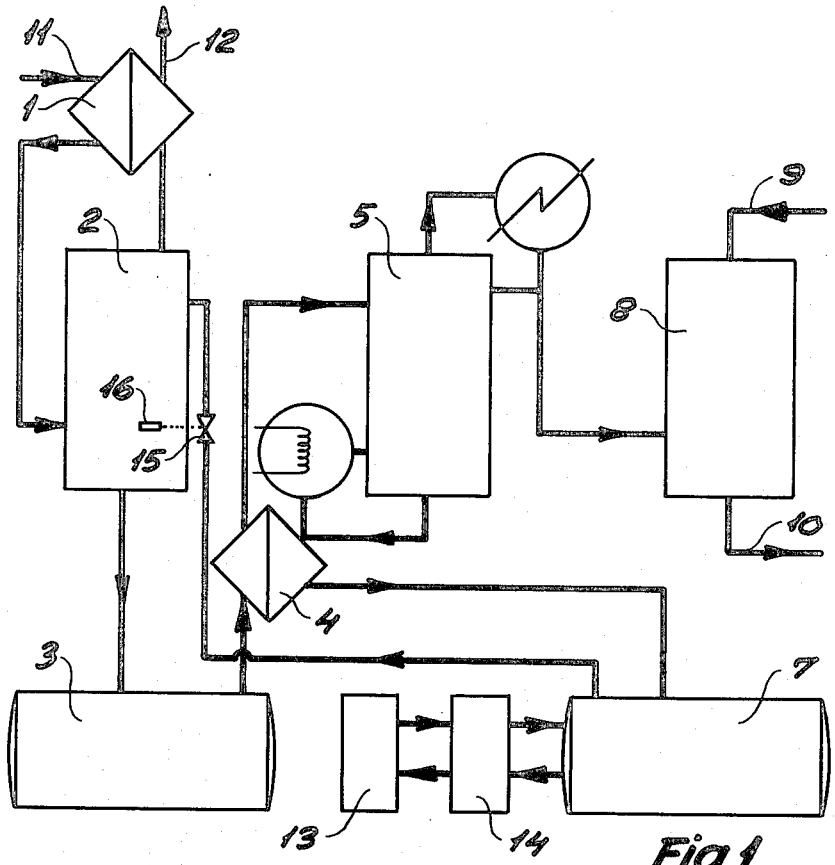

METHOD FOR THE RECOVERY OF PETROL (GASOLINE) FROM A MIXTURE OF PETROL VAPOR AND AIR, AND A SYSTEM FOR USE IN THE METHOD

The present invention relates to a method for the recovery of petrol from a mixture of petrol vapour and air, in which the petrol vapour is absorbed in an absorption means by direct contact with a cooled petroleum distillate, and then the petrol dissolved in the petroleum distillate is stripped so that the petroleum distillate circulates in a substantially closed circuit, and a system for carrying out the method.

Ordinary motor petrol has a high vapour pressure at normal ambient temperatures both in summer and winter. Therefore, in normal circumstances, the concentration of petrol vapour above the liquid in a storage tank will amount to about 1.3 l (calculated as liquid petrol) per $M^3$. This high petrol vapour concentration causes a great loss of petrol vapour particularly in the filling of storage tanks and tank trucks. Likewise, losses occur from storage tanks by breathing because of variations in the temperature. The total losses in these processes are about 0.2%, based on the amount of petrol, and in a country such as Denmark this corresponds to several millions Danish kroner.

Some methods are already known in the field which aim at reducing these losses. The purpose of some of them is to prevent the occurrence of petrol vapour, e.g. by the mounting of floating roofs on storage tanks. However, this principle is only useful on stationary tanks and involves considerable operating problems.

Moreover, in the pumping of petrol from one container to another it is known to recycle the petrol vapours from the second container to the first one. This method is effective, but has so many limits in practice that normally it is only used in combination with other methods.

The predominant methods among these are based on filtration with active carbon. However, these methods involve great investment and operating costs and are vitiated by the considerable weakness that they cannot handle the very large amounts of petrol vapour which occur at peak loads, e.g. in the filling of storage tanks from a tanker, where the amount of petrol may e.g. constitute 6000 $m^3$ in ten hours, unless the system is unrealistically big and thus expensive.

The art moreover comprises methods based on cooling condensation or freezing of the hydrocarbons contained in petrol/air mixtures by intense refrigeration of the mixture, often to −70° C. A method of this type is described in the SE Published Application No. 391 046. Since the petrol vapours are mainly composed of gases, such as butane, very low temperatures are required, which makes the process less attractive. As moreover the mixture usually contains water vapour which will condense together with the hydrocarbons, a special separation step is required to remove the water. To reduce the danger of explosions it is necessary to presaturate the mixture with crude petrol in order to safely increase the dew point of the mixture during compression and to thereby reduce the cooling requirement. This compression of the air, however, adds to the cost of the process.

An alternative principle relies upon washing of the petrol vapours with an absorbing liquid, preferably oil, from which the absorbed petrol is stripped, usually by distillation. This principle has several drawbacks. First, the vapour pressure of the mixture increases with increasing absorption of petrol, which reduces the absorption capacity, and secondly the solution of petrol in the oil is accompanied by generation of heat, which has an additional adverse effect on the absorption equilibrium This entails that the system becomes uneconomical, both in terms of size and operation, if it is to be dimensioned with a view to the peak loads occurring e.g. when a tanker is emptied.

In the DE Offenlegungsschrift No. 2 218 199 features from some of the above-mentioned methods are combined; for the recovery of an evaporated liquid, such as petrol, contained in a gas, a stream of the same liquid is continuously passed from a storage tank in a closed circuit through a cooling zone and a primary concentration zone back to the storage tank, the gas being brought into direct contact with the liquid in the condensation zone so that the evaporated liquid is condensed and absorbed in the liquid circuit.

For this principle to be useful in practice for the recovery of petrol, a large number of supplementary measures are taken according to that publication:

To counteract the problems of water vapour condensation by the contact between the petrol/air mixture and the cooled petrol, a freezing point depressing medium, such as methanol, is injected by spraying during this contact, but this medium must later be isolated by fractionation and be recovered in a special regeneration zone.

To reduce the danger of explosions and enable compression of the petrol/air mixture, the mixture is presaturated with petrol. The saturated mixture is passed through a compression zone and is en route subjected to a plurality of stripping steps where condensed petrol is stripped and recycled to the storage tank. The compressed petrol/air mixture is then caused to contact cooled petrol in a primary condensation zone, but since normally all the petrol vapor cannot be absorbed in the cooled petrol, the partly stripped petrol/air mixture is passed on to a secondary condensation zone in which it is brought into contact with a heavier petrol fraction from a special fractionation zone. Only then is the air sufficiently lean of petrol to be released to the atmosphere.

The system moreover comprises a plurality of compressors, stripping zones and control mechanisms and a very complicated piping which together constitute a plurality of circuits in which the various fractions obtained en route are suitably treated or recycled.

To be able at all to cope with peak loads this extremely complicated system operates continuously, which means that in normal operation it is over-sized and does not provide an optimum concentration of absorbed petrol vapour in the cooled petrol, just as the fractionation zone is unnecessarily loaded to separate the petrol into a heavy fraction for the treatment in the secondary condensation zone and a light fraction which passes with the added (aqueous) methanol to the recovery zone thereof and is then recycled to the presaturation zone.

The process described in the DE Offenlegungsschrift No. 2 218 199 is based on the captivating thought of using the same liquid (petrol) as absorbing medium for the gas to be stripped from the air.

The problem in that connection is that even when intensely cooled the petrol has a high vapour pressure so that the theoretically best possible stripping will be poor. It is attempted to solve this problem by separating the petrol used for the absorption in two fractions and carrying out a supplementary stripping with the highest boiling fraction, which seems to be both laborious and expensive. To this should be added that a petrol store of the size necessary to achieve a reasonably efficient operation is extremely expensive and requires extensive safety measures.

It is moreover doubtful whether the system is actually able to provide an effective stripping within reasonable economic limits in case of heavy loads, e.g. when a tanker is emptied, and as a matter of fact the more concrete part of that publication only refers to tank trucks.

The reason is that the temperature in the petrol storage tank must be assumed to increase rapidly because of the absorption heat, which partly reduces the absorption capacity, partly increases the cooling requirement, unless an extremely big storage tank is used.

To compensate for the inadequate absorption capacity, the petrol/air mixture is compressed, as mentioned. In addition to the increased cost involved by this, also the risk will be significantly enhanced, which it is attempted to overcome by introducing an extra presaturation step. It is clear, however, that the more mechanical/electric unit operations introduced in the system, the greater the risk of errors and accidents.

The object of the present invention is to provide a method and a system capable of efficiently and economically recovering petrol from petrol/air mixtures even at peak loads, without it being necessary to oversize the system or adopt risky processing steps.

This is achieved by a method which is of the type set forth in the opening paragraph and is characterized in that the absorbing medium is a petroleum distillate having a higher boiling point range than petrol, and that the petroleum distillate in sequence is at least: (1) cooled by heat exchange with a cold reservoir, (2) brought into direct contact with the petrol/air mixture to absorb petrol, (3) transferred to a buffer tank and (4) transferred from the buffer tank to a stripping means, preferably a distillation column, the amount of cooled petroleum distillate caused to contact the petrol/air mixture being controlled so that the concentration of petrol in the petroleum distillate transferred to the buffer tank is substantially constant.

Thus, the invention consists in a combination of some features known per se and some novel features which together provide a surprising effect. It will be appreciated that the combination of cooling condensation and absorption used according to the invention causes a strong evolution of heat in the absorption means, which in combination with means for regulating the petrol concentration in the petroleum distillate transferred to the buffer tank enables effective control of the supply of cooled absorbing medium both at peak loads and at normal loads. This imparts an unprecedented flexibility to the system, without it being necessary to oversize it and thus make it uneconomical in terms of capital and operating expenditure.

On the other hand, the control mentioned is a prerequisite for an efficient and economical operation as, otherwise, large amounts of cooled medium would have to be circulated in the system in order to cope with peak loads. Owing to the buffer tank the distillation column may be dimensioned for average loads, and in this context it is important to note that the system is not equipped with an arbitrarily big buffer tank, but a surprisingly small tank; this is possible because the absorption process is controlled so that the petroleum distillate contained in the buffer tank constantly contains the highest possible concentration of petrol.

The method carried out as stated in claim 2 provides a reduction in the total power consumption of the system for the necessary heating and cooling processes in the circuit of the petroleum distillate. Another result of the process defined in claim 1 is that the cleaned exhaust air from the absorption means has a substantially constant, low temperature, which is utilized, according to claim 3, for cooling the petrol/air mixture in a separate heat exchanger to condense water vapour in the petrol/air mixture. This precooling of the petrol/air mixture is preferably controlled by a flowing cooling medium, as stated in claim 4, the basis for which is that a constant, low temperature can be expected in the exhaust air of the absorption means. It should moreover be noted that an increased flow amount of the petrol/air mixture requires an increased cooling effect, but this is precisely provided for by the simultaneous increase in the amount of stripped, cold exhaust air from the absorption means.

In a preferred embodiment the method is carried out as stated in claim 5 so that a substantially constant, low temperature is maintained in the mixing zone, corresponding to a substantially constant petrol content in the petroleum distillate flowing down into the buffer tank. The absorption means is preferably formed as a washing tower, and when the petroleum distillate is supplied at several levels in the washing tower, the tower may work with a plurality of different temperature zones. The temperature in these zones may be controlled by carrying out the method as stated in claim 7, resulting in an optimum temperature regulation in the tower. The latter temperature regulation can be utilized as compensation means in the control of the total amount of cooled petroleum distillate supplied to the tower and also of the mutual distribution of the amounts to the various levels so that residual water vapour in the petrol/air mixture can be condensed in a lower zone spaced from an upper zone, which may be packed with the packing bodies.

The absorbing medium used according to the invention is a petroleum distillate having a higher boiling point range than the petrol to be recovered, typically motor petrol or aviation petrol.

To achieve the object of the invention, the petroleum distillate must satisfy the following criterions:

- It must be essentially free of smells or have only a slight smell.
- It must have a lower vapour pressure under the conditions of use.
- It must have a freezing point (range) below the temperature of use.
- It must have a suitably low viscosity under the conditions of use.

Depending upon the stripping method used, it should have a boiling point range whose lower limit is suitably different from that of the dissolved petrol components.

These criterions are met by a petroleum fraction, marketed in Denmark under the name of "petroleum", having a boiling point of about 180°–250° C., which is the preferred absorbing medium.

Higher boiling fractions, such as diesel oil and fuel oil, are less suitable, in particular because of a high freezing point and too great smell.

The system of the invention is characterized by the construction defined in claim 10, and the subsequent claims define some details expedient to achieve the effects described in the foregoing.

Figure 2:
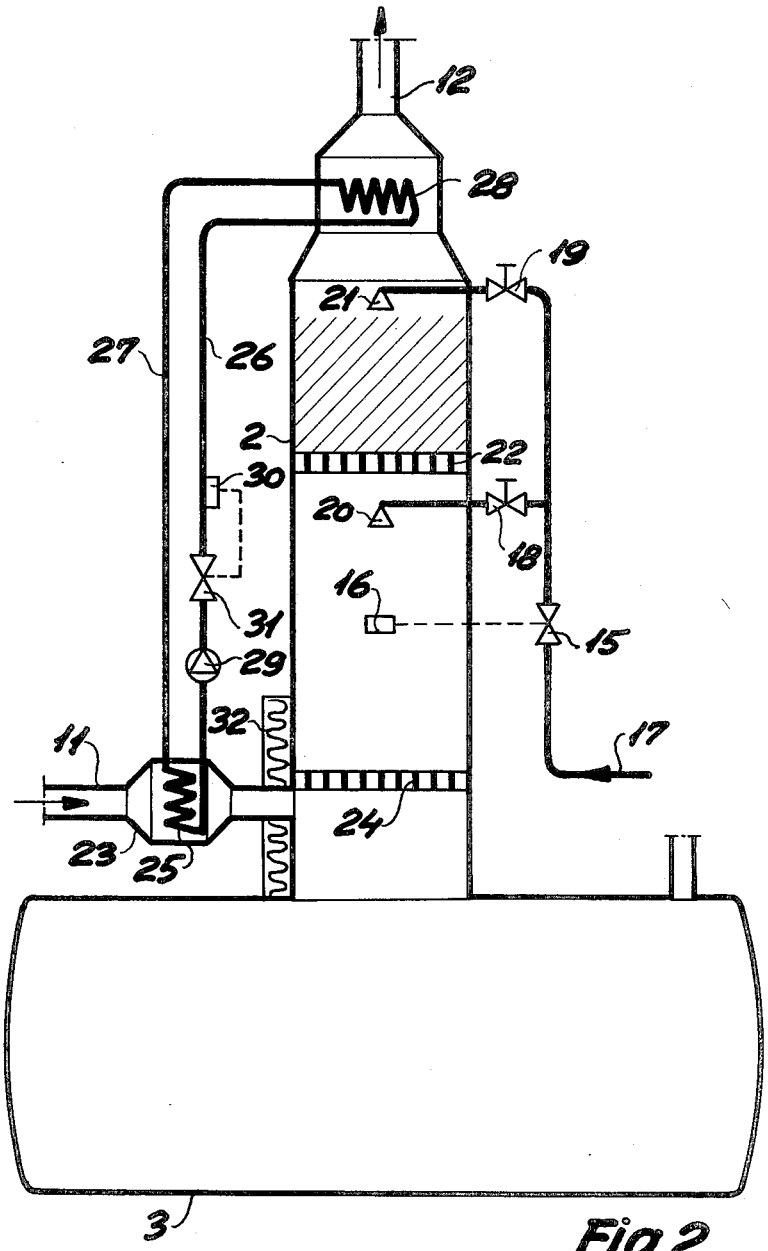

The invention will be explained in greater detail by the following description of an embodiment with reference to the drawing, in which FIG. 1 schematically shows a block diagram of an embodiment of the system of the invention, while FIG. 2 shows details of an embodiment of a washing tower for the system of the invention.

The preferred embodiment of the system of the invention comprises the components which are shown schematically in FIG. 1 and will be explained below in connection with the description of the mode of operation of the system.

The petrol/air mixture to be cleaned is passed to the system through a conduit 11 after having first passed various non-return valves, etc. As will be explained later, the petrol/air mixture is advantageously stripped of by far the greatest part of its water content in the heat exchanger 1, from which the mixture is conducted to an absorption means 2 which also receives cooled petroleum distillate via a controllable valve 15, as will be explained more fully in connection with FIG. 2. In the absorption means 2 the petrol vapour is absorbed in the petroleum distillate, which is passed to a buffer tank 3, while the cold air stripped of petrol is discharged to the atmosphere as indicated at 12 by the heat exchanger 1 so that the cold air provides the cooling effect required to condense water. The petrol-containing petroleum distillate is conducted from the buffer tank 3 to a stripping means, in the shown system a distillation column 5 where the petroleum distillate is stripped of petrol by heating and is then passed to a storage tank 7, in which the petroleum distillate is cooled before being recycled to the absorption means 2. The heat exchanger 4 reduces the power consumption of the system since the cold petroleum distillate from the buffer tank 3 is preheated before being transferred to the distillation column 5, while the hot petroleum distillate from the distillation column 5 is precooled before being transferred to the storage tank 7. It is observed that the heat exchanger 4 provides optimum savings in energy because it can be dimensioned to a predetermined flow volume, which is substantially constant under all operating conditions owing to the presence of the buffer tank 3. The petrol vapours given off by the distillation are transferred to a washing chamber 8, e.g. a packed column, through which liquid petrol absorbing the petrol vapours flows via conduits 9, 10. Alternatively, the vapours may be condensed or compressed in a manner known per se. The numerals 13 and 14 represent a cooling system and a heat exchanger, respectively, for cooling the petroleum distillate in the storage tank.

FIG. 2 shows details of some important components in the system of FIG. 1, viz. the absorption means 2, the buffer tank 3 and the heat exchanger 1. As mentioned, the absorption means 2 is preferably constructed as a washing tower to which the petrol/air mixture is passed in countercurrent flow with the cooled petroleum distillate serving as absorbing medium. The washing tower can in principle be constructed in many ways. A suitable type is e.g. a packed type countercurrent column (packing body column). In such columns, depending upon the water vapour content and the temperature, icing may occur on the packing bodies, which must then be removed e.g. by occasional thawing or introduction of a freezing point depressing agent, such as methanol.

A type which is better able to resist icing is a spray column, but such a column does not have quite optimum countercurrent characteristics.

In view of this, it is preferred to combine these two types as is illustrated in FIG. 2 and explained below.

The cooled petroleum distillate is passed via the conduit 17 through the control valve 15 to two inlets in the washing tower 2 via respective regulating valves 18, 19, enabling control of the amount of petroleum distillate which is passed to respective spray nozzles 20, 21. The hatched upper region of the washing tower 2 is filled with packing bodies, such as saddles resting on a grate 22.

The petrol/air mixture is passed to the plant via the conduit 11 and through a heat exchanger 23, incorporated in the heat exchanger 1 shown in FIG. 1, to the bottom of the absorption tank 2 where the mixture flows upwards, the flow being regulated by a distributor grate 24. The nozzle 20 emits a mist of cooled petroleum distillate, preferably at −25° C., so that part of the petrol vapour is absorbed in the petroleum distillate simultaneously with an additional small amount of water vapour in the petrol/air mixture being condensed. The purpose of this is to ensure that practically no ice is deposited on the packing bodies so that a very effective final stripping by means of the petroleum distillate from the nozzle 21 is achieved. The valves 18, 19 are set so that no noticeable icing will occur on the packing bodies, ensuring that as much of the stripping effect as possible takes place around the packing bodies, which provide a considerable increase in the surface area and thus a more effective stripping with respect to the volume of the washing tower. Thus, the valves 18, 19 enable a relative temperature distribution in the washing tower, while the absolute temperature control is provided for by means of the valve 15, whose temperature sensor 16 is fitted in the washing tower as shown in FIG. 2. This simultaneously results in the feature which is essential to the invention, viz. that the substantially constant temperature around the temperature sensor 16 causes the petrol concentration in the petroleum distillate conducted down to the buffer tank 3 to be substantially constant, corresponding to optimum operating conditions so that the buffer tank 3 may have a significantly smaller volume than the one which would have been necessary if the concentration of petrol in the petroleum distillate fluctuated between zero and a maximum value.

When the washing tower 2 is mounted directly on top of the buffer tank 3, no pumps are required between the bottom of the washing tower and the buffer tank. As the concentration of petrol in the petroleum distillate is kept at a maximum value according to the invention, there would be a risk of cavitation in a pump, it being observed that a pump between the washing tower 3 and the buffer tank has to be dimensioned for peak loads, while the necessary pump (not shown) between the buffer tank and the distillation column only has to be dimensioned for the significantly smaller average loads.

An additional advantage of the temperature control in the washing tower 2, as described in the foregoing, is that the petrol-stripped air flowing out through the outlet 12 has a substantially constant temperature and occurs in an amount per unit of time corresponding to the amount introduced through the inlet 11. According to the invention, this is utilized for precooling the petrol/air mixture from the conduit 11 so that by far the greatest part of the water vapour contained in it is condensed in the heat exchanger 23, which has means (not shown) for discharging the accumulated water. The heat exchanger 23 comprises a pipe coil 25 connected to another pipe coil 28 at the top of the washing tower 2 through conduits 26 and 27, so that a heat transferring medium circulated through the pipes by means of a pump 29 can transfer refrigerating effect from the exhaust air of the washing tower to the heat exchanger 23. A valve 31 is controlled by means of a temperature sensor 30 so as to maintain a substantially constant temperature in the cooling circuit of the incoming petrol/air mixture.

As stated in the foregoing, the system of the invention is specially intended to cope with very great peak loads by means of significantly simpler means than has been feasible in the past and to cope with the ordinary loads in an optimum manner. In this context it should be emphasized that only the washing tower 2 and the heat exchanger coils 25, 28 are dimensioned for peak load operation (preferably 800 $m^3$ per hour), while all the other components in the system need only be dimensioned for average operation. The petroleum distillate is transferred by means of a circulation pump (not shown) from the buffer tank 3 to the distillation column 5 with a constant amount per unit of time, adapted to average conditions, so that a heavy peak load does not influence the operating conditions of the distillation column 5. In the preferred embodiment the storage tank 7 is given such a great volume that the cooling plant 13, too, is only dimensioned for average loads. It should be mentioned in this connection that the volume of the storage tank 7 may be reduced by setting up a separate cold store containing a brine liquid, which has a considerably greater specific heat than the petroleum distillate so that the petroleum distillate is heat exhanged with the cold reservoir before being transferred to the washing tower 2 by means of a pressure pump (not shown).

It will be appreciated that the washing tower 2, which is preferably made of stainless steel, and optionally also the buffer tank 3 are heat insulated as is schematically indicated by the insulation store 32, which also applies to the storage tank 7, and that the plant is provided with details known per se, such as drive pumps for the petrol/air mixture and the petroleum distillate.

What is claimed is:

1. A method for the recovery of petrol from a mixture of petrol vapour and air, in which the petrol vapour is absorbed in an absorption means by direct contact with a cooled petroleum distillate supplied from a storage tank, and then the petrol dissolved in the petroleum distillate is stripped so that the petroleum distillate circulates in a substantially closed circuit, characterized in that the absorbing medium is a petroleum distillate having a higher boiling point range than petrol, and that the petroleum distillate in sequence is at least: (1) cooled by heat exchange with a cold reservoir, (2) brought into direct contact with the petrol/air mixture to absorb petrol, (3) transferred to a buffer tank and (4) transferred from the buffer tank to a stripping means, the amount of cooled petroleum distillate caused to contact the petrol/air mixture being controlled so that the concentration of petrol in the petroleum distillate transferred to the buffer tank is substantially constant.

2. A method according to claim 1, wherein the petroleum distillate conducted from the buffer tank to the stripping means is caused to be in heat exchanging relationship with the petroleum distillate which is passed from the stripping means to the cold reservoir.

3. A method according to claim 1, wherein the air, stripped of petrol and cooled after contact with the cooled petroleum distillate, is caused to be in indirect heat exchanging relationship with the incoming petrol/air mixture.

4. A method according to claim 3, wherein the heat exchanging relationship is provided through a flowing cooling medium, and that the flow amount per unit of time is controlled in dependence upon the temperature of the petrol/air mixture.

5. A method according to claim 3, wherein any water condensed by such heat exchanging relationship is separated before the petrol/air mixture is brought into contact with cooled petroleum distillate.

6. A method according to claim 1, wherein the amount of cooled petroleum distillate brought into contact with the petrol/air mixture is controlled in dependence upon the temperature in a mixing zone for the petrol/air mixture and the petroleum distillate, respectively.

7. A method according to claim 6, in which the petrol/air mixture is absorbed in the petroleum distillate in a washing tower, the petroleum distillate being introduced at several levels in the washing tower.

8. A method according to claim 7, wherein the amounts of petroleum distillate passed to the respective levels in the washing tower are mutually regulated to obtain a predetermined, vertical temperature distribution in the tower.

9. A method according to claim 1, wherein the stripping means is a distillation column.

10. A system for the recovery of petrol from a mixture of petrol vapour and air, comprising an absorption means to absorb petrol from a received petrol/air mixture by means of a cooled petroleum distillate, said absorption means being connected to a stripping means to strip petrol dissolved in the petroleum distillate and a storage tank for petroleum distillate, respectively, characterized in that a buffer tank (3) is mounted between the absorption means (2) and the stripping means (5), and that flow regulating means (15, 16), which are dependent upon the temperature in a mixing zone in the absorption means (2), are interposed between the storage tank (7) and the absorption means (2).

11. A system according to claim 10, including a heat exchanger assembly (1) comprising one heat exchanger coil (25) placed in the received petrol/air mixture and a second heat exchanger coil (28) placed in the cold, petrol-stripped exhaust air from the absorption means (2), said heat exchanger coils being interconnected to form a closed circuit for a heat transferring medium having a controllable flow rate.

12. A system according to claim 10, including a heat exchanger (4) through which a substantially constant amount of petroleum distillate per unit of time flows to and from the stripping means (5).

13. A system according to claim 10, in which the absorption means is a washing tower, the washing tower (2) having a plurality of injection nozzles (20, 21) at different heights, and the flow regulating means comprising a valve (15) which is dependent upon the temperature at a predetermined height (at 16) and is adapted to regulate the total amount of petroleum distillate supplied to the tower so that the concentration of petrol in the petroleum distillate supplied to the buffer tank (3) is substantially constant.

14. A system according to claim 10, wherein the absorption means (2) is mounted directly on top of the buffer tank (3).

* * * * *